US006321699B1

(12) United States Patent
Britton

(10) Patent No.: US 6,321,699 B1
(45) Date of Patent: Nov. 27, 2001

(54) SPHEROIDAL ROTARY VALVE FOR COMBUSTION ENGINES

(76) Inventor: Richard Berkeley Britton, P.O. Box 7451, Charlottesville, VA (US) 22906

( * ) Notice: Subject to any disclaimer, the term of this patent is extended or adjusted under 35 U.S.C. 154(b) by 0 days.

(21) Appl. No.: 09/139,462

(22) Filed: Aug. 25, 1998

Related U.S. Application Data

(60) Provisional application No. 60/057,354, filed on Aug. 25, 1997.

(51) Int. Cl.[7] ..... F01L 7/00

(52) U.S. Cl. ..... 123/80 R; 123/80 BA; 123/41.4; 123/190.13; 123/190.14; 123/188.9

(58) Field of Search ..... 123/80 R, 80 BA, 123/190.1, 190.13, 190.14, 190.16, 190.17, 41.4, 190.4, 190.6, 190.8, 188.9

(56) References Cited

U.S. PATENT DOCUMENTS

| | | | | |
|---|---|---|---|---|
| 880,601 | | 3/1908 | Thompson . | |
| 942,124 | | 12/1909 | Wridgway . | |
| 1,018,386 | | 2/1912 | Ballou . | |
| 1,080,892 | | 12/1913 | Chandler . | |
| 1,212,196 | | 3/1917 | Moorehead . | |
| 1,218,296 | * | 3/1917 | Moorhead . | |
| 1,868,301 | | 7/1932 | Zeeman . | |
| 2,725,043 | * | 11/1955 | Bacot | 123/41.4 |
| 2,745,395 | * | 5/1956 | Genet | 123/190.8 |
| 3,945,364 | * | 3/1976 | Cook | 123/190.14 |
| 3,965,681 | | 6/1976 | Wyczalek et al. | 60/599 |
| 4,114,639 | * | 9/1978 | Cross et al. | 137/246.22 |
| 4,606,309 | | 8/1986 | Fayard | 123/190 DL |
| 4,782,801 | * | 11/1988 | Ficht et al. | 123/190.8 |
| 4,821,692 | | 4/1989 | Browne | 123/190 A |
| 4,834,038 | * | 5/1989 | Montagni | 123/190.8 |
| 4,858,577 | * | 8/1989 | Matsuura et al. | 123/190.2 |
| 4,989,558 | * | 2/1991 | Coatey | 123/190.14 |
| 5,109,814 | * | 5/1992 | Coates | 123/190.14 |
| 5,361,739 | * | 11/1994 | Coates | 123/190.14 |
| 5,483,928 | * | 1/1996 | Mahlberg et al. | 123/41.42 |

FOREIGN PATENT DOCUMENTS 970264 6/1950 (FR) .

* cited by examiner

*Primary Examiner*—Henry C. Yuen
*Assistant Examiner*—Hai Huynh
(74) *Attorney, Agent, or Firm*—Daniel M. Schaeffer

(57) ABSTRACT

A rotary valve is disclosed suitable for replacement of poppet valves. The valve is temperature controlled through a combination of heat transfer techniques and means for reducing heat transfer between gas flows and the valve components. Assymetric geometry is used in the seals to reduce wear and friction, and a removable combustion chamber in the valve housing is used to facilitate fabrication, servicing and performances. A prototype of the valve was developed for a 30 cubic inch displacement four-stroke spark-ignition engine. The gas seals and lubricated parts of the rotary valve have been found to remain below 400 degrees Fahrenheit during test runs wherein the valve controlled gas flows and has maintained a brake mean effective pressure of 108 to 121 psi for periods of up to an hour.

The valve uses pure rotation, and can be dynamically balanced for operation to the peak RPM permissible with reciprocating pistons. A four-stroke engine converted to rotary valving needs very few parts. For example, a four cylinder automotive engine fitted with a spheroidal rotary valve system requires only 11 moving parts; namely a crankshaft, pistons and rods, the valveshaft and a timing belt to drive the valveshaft. The valve is applicable to new engine production and is also suitable as a cylinder head assembly for retro-fit to existing engines of the overhead camshaft type.

27 Claims, 9 Drawing Sheets

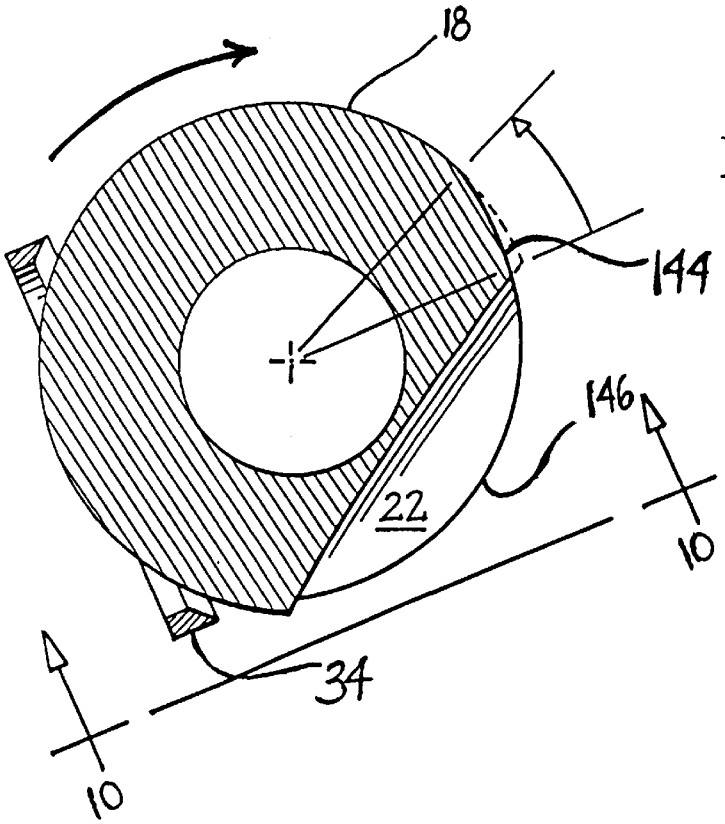
Fig. 9
Fig. 10
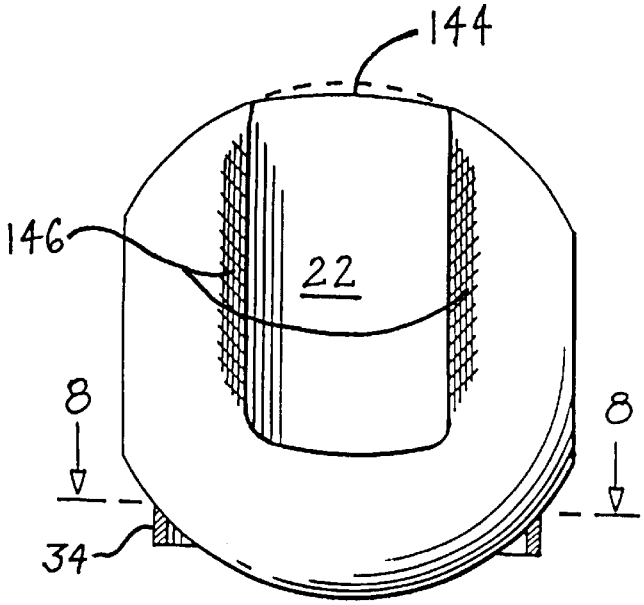

Fig. 11
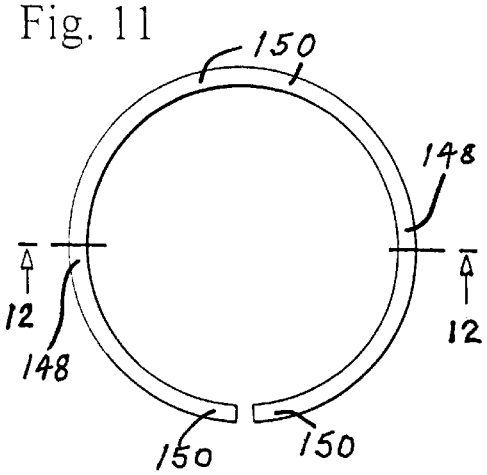
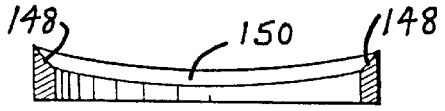
Fig. 12
Fig. 13
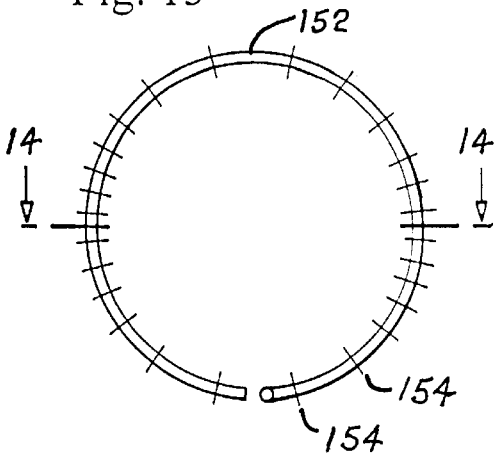
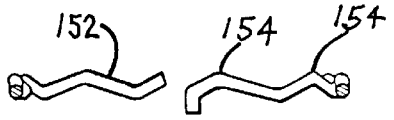
Fig. 14
Fig. 15
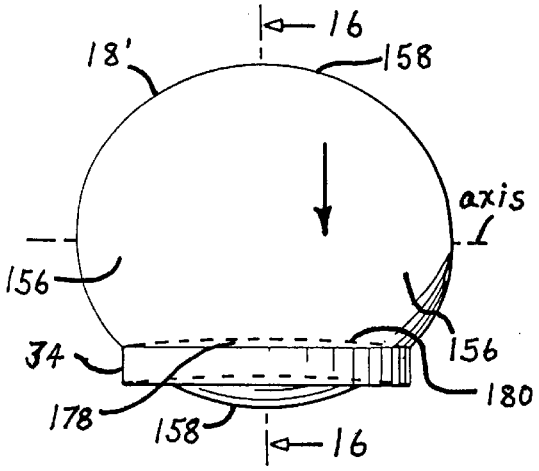
Fig. 16
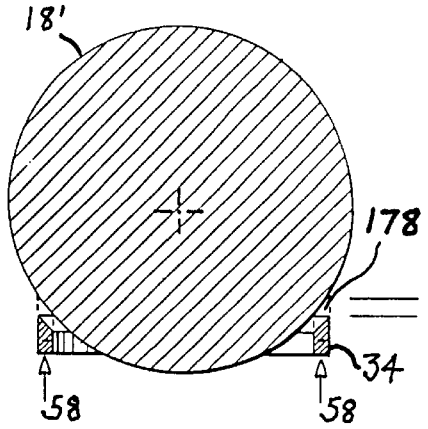

SPHEROIDAL ROTARY VALVE FOR COMBUSTION ENGINES

REFERENCE TO PRIOR APPLICATIONS

This utility patent application is filed with reference to a provisional application entitled: Spheroidal Rotary Valve for Combustion Engines filed at the USPTO on Aug. 25, 1997 and Ser. No. 60/057,354.

BACKGROUND OF THE INVENTION

1. Field of the Invention

This invention relates to rotary valves for use with internal combustion engines. It relates further to means for cooling rotary valves and other rotary mechanisms. It relates still further to the lubrication of rotary valves. It also relates to rotary valves having a spherical shape or a shape which is similar such as an ovoid, obloid, ellipsoid, parabaloid, ball, globular and so forth. This group of shapes will be referred to herein as spheroidal.

2. Background of the Invention

Valves known to be suitable for internal combustion engines may be classified according to both their action, which may be either lifting or sliding, and their motion which may be classed either as oscillatory or continuous. The conventional poppet valve for example has lift action and its operation requires oscillatory motion. The sliding action valve however may be designed to operate either with oscillatory motion or with a continuous motion provided by rotation, the latter valves being classed as rotary.

During development of the combustion engine, inventors have sought a continuous motion to improve on the oscillatory poppet with its speed limitations, complexity, cost, and in some cases, noise. In the prior art, an estimated 2,000 patents may be found which relate to novel rotary valves for use on an IC engine. Of these, approximately 70 patents, including both U. S. and foreign, may be found which relate to spheroidal valves. The following have relevance to the invention herein.

Charles G. Wridgway, an Englishman, in U.S. Pat. No. 942,124 issued Dec. 7, 1909 fully describes application of a spheroidal valve to an IC engine. The ingenuity and limited claims of Wridgway's invention suggests that earlier art existed when he applied Dec 31, 1908. His use of a single valve rotor to valve two adjacent cylinders of an engine has considerable merit however and was apparently used in the cylindric valved Itala engines.

M. G. Chandler in U.S. Pat. No. 1,080,892 issued Dec. 9, 1913 describes a spherical rotary valve with a peripheral port and fixed sealing ring. It is not known whether Chandler's valve worked, as no split is shown or described in the circular seal used to seal combustion pressure against the sphere. If no split was used and thus no possibility for radial expansion of the ring under gas pressure, the valve seal would have leaked, probably making the engine inoperable. If Chandler did use a split seal, the rotary valve engine would probably have operated well for several minutes. Provision for cooling however appear to be insufficient. Therefore, if run at any appreciable power output, the valve rotor would have overheated. Chandler does not describe any necessity for specifically cooling the seal. His valve also appears to have contacted the casing over its entire surface which would have created problems.

Jan Zeeman in U.S. Pat. No. 1,868,301 issued Jul. 19, 1932 discusses the need to regain the explosive gas-mixture left in the valve chambers after the inlet (stroke) and a method for accomplishing it. No special control of the scavenging flow is described.

Jean-Claude Fayard in U.S. Pat. No. 4,606,309 issued Aug. 19, 1986 describes a method of scavenging wherein the inducted mixture is leaned out towards the end of the inlet stroke. Fayard's method and end result both differ from the scavenging described herein.

The prior art regarding gas sealing indicates that other inventors consider the seal situation workable but not perfected. The variety of recent patents issued on seals for a rotary valve indicate that other inventors have not finalized a workable seal arrangement.

Metered lubrication is a straight forward mechanical engineering problem. However known metering methods that allow control of oil flow are complicated and expensive. No prior art could be found re a metering system as described herein.

Cooling methods were found for a rotary valve such as the following:

1) Flowing coolant through a hollow rotor shaft and through the rotor,
2) Flooding the rotor surface with coolant and re-collecting the coolant,
3) Spraying water through the hot rotor port,
4) Conducting heat out to a pad or a portion of the rotor casing held tightly against the rotor, the pad or casing portion being cooled.

James I. Thompson in U.S. Pat. No. 880,601 issued Mar. 3, 1908 for example clearly describes a frusto-conical valve for the combustion chamber of a gas engine and teaches a method for flowing water or air coolant through the valve. Other patents describe internal coolant flow through rotary cylindric and spheric valves. Due to the need for at least one rotary seal in the valve shaft for liquid coolant, these cooling methods cannot achieve the high reliability and low cost of contemporary poppet valve art.

E. Ballou in U.S. Pat. No. 1,018,386 issued Feb. 20, 1912 describes a rotary valve having double curvature and includes ovoids and ellipsoids. Ballou does not elaborate and gives no specific preferred shapes, no reasons for using such shapes in lieu of spherical shapes, and no suggestions for engineering such shapes into a valve. No detail was given regarding the amount of double curvature desired and very little was said as to the improvement obtained on valve operation by its use. Ballou's non-spherical shapes appeared to be merely concepts, with very little taught about their benefit or method of use.

J. J. Genet in French Patent # 970,264 issued Jan. 2, 1951 discusses ellipsoidal and ovoidal shapes for a rotary valve rotor. However, he does not describe how such shapes should be designed and used in a valve nor what purpose they serve, and he provides no drawings. Genet's non-spherical shapes do not appear to be sufficiently well taught for someone skilled in engine art to understand their purpose or to understand how to apply them to an engine and obtain a benefit over the use of a spherical valve, since even the spherical shape is almost unknown except in the world's patent files.

D. F. Browne in U.S. Pat. No. 4,821,692 issued Apr. 18, 1989 describes a spherical valve rotor rotatable and offsetable in a spheroidal casing to obtain better sealing. Browne's invention was determined to be geometrically different from my invention described herein.

Albert E. Moorhead in U.S. Pat. No. 1,218,296 issued Mar. 6, 1917 describes a spherical valve rotor using a through port insulated from the surface by a filling of asbestos or other insulating material. The insulated port alone is therefore old art. The "through port" valve of Moorhead's has approximately three times the surface area of a peripheral port and would collect three times as much heat from the exhaust. It would be difficult to keep such a valve properly cool.

F. A. Wyczalek et al in U.S. Pat. No. 3,965,681 issued Jun. 29, 1976 describes a metal liner in an engine exhaust port, the purpose being to carry the hot exhaust gas more efficiently to an exhaust turbine. This is in effect an insulating liner in the port with no attempt to conduct heat downstream and away from the cylinder head.

Some two-stroke engines are now being manufactured with auxiliary rotary inlet or exhaust valves placed in series with piston valved ports on the cylinder walls. These valves aid in timing gas flows in a two-stroke engine and in such application, they withstand only a few pounds per square inch, their designs being inadequate for the thousand pounds per square inch of a combustion chamber.

No prior art was found describing the art of cooling a rotary valve as is taught herein. No mention was found regarding the control or metering of oil to a rotary valve.

SUMMARY OF THE INVENTION

The valve invention herein is an improvement on the rotary valves of the prior art. The improvement is achieved by a combination of elements which must be used together for maximum effect. These include means to reduce heat input into a spheroidal rotary valve, means to distribute heat and conduct it through the valve, and means to conduct heat out of the valve. Most of the described elements are required in a valve used on a high output (BMEP>100 psi) engine.

For the valve to be practical, it also requires controlled lubrication, and for economical operation this requires metering. An oil metering system with output that correlates with RPM and IMEP is therefore included. It can be built either into the valve body or into an adjacent bearing which carries the valve.

An insert type sleeve bearing with pressure oil feed, self contained seals and associated oil drains at each end and a built in oil release port was devised. It serves to control potential oil loss to the valve casing space from the multiplicity of bearings needed along the rotor shaft.

A scavenging mechanism is described which retrieves fuel-air charge that gets trapped in the rotor port.

Since these separate innovations all contribute to making the rotary valve a practical mechanism, they are being described here and submitted in a single application.

BRIEF DESCRIPTION OF THE DRAWING FIGURES

FIG. 9 is a spherical valve in section showing relief at the leading edge of the rotor port.

FIG. 10 is a planform view of the valve of FIG. 9 taken along line 10—10 and showing reliefs along the sides of the rotor port.

FIG. 11 is a planform view of a shaped sealing ring.

FIG. 12 is a sectional view of the scaling ring of FIG. 11.

FIG. 13 is a planform view of a non-uniform spring for use under a sealing ring.

FIG. 14 is a sectional view of the spring of FIG. 13.

FIG. 15 is a perspective view of an elongated rotor in combination with a circular heat transfer member.

FIG. 16 is a sectional view along line 16—16 of FIG. 15.

DETAILED DESCRIPTION OF THE INVENTION

Figure 1:
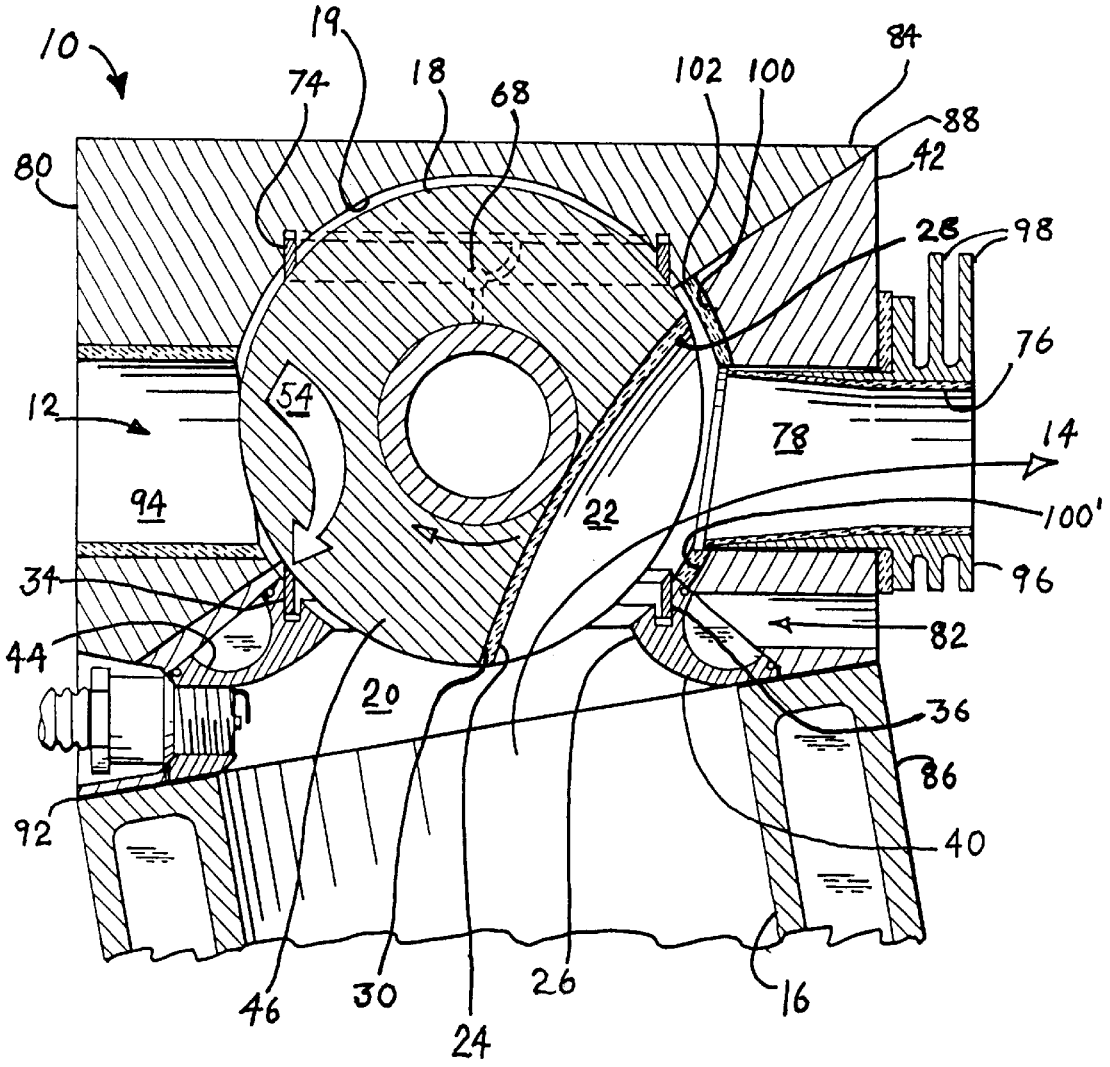
FIG. 1 is a sectional view parallel with the axis of a spheroidal rotary exhaust valve and associated oil metering mechanism.
Figure 2:
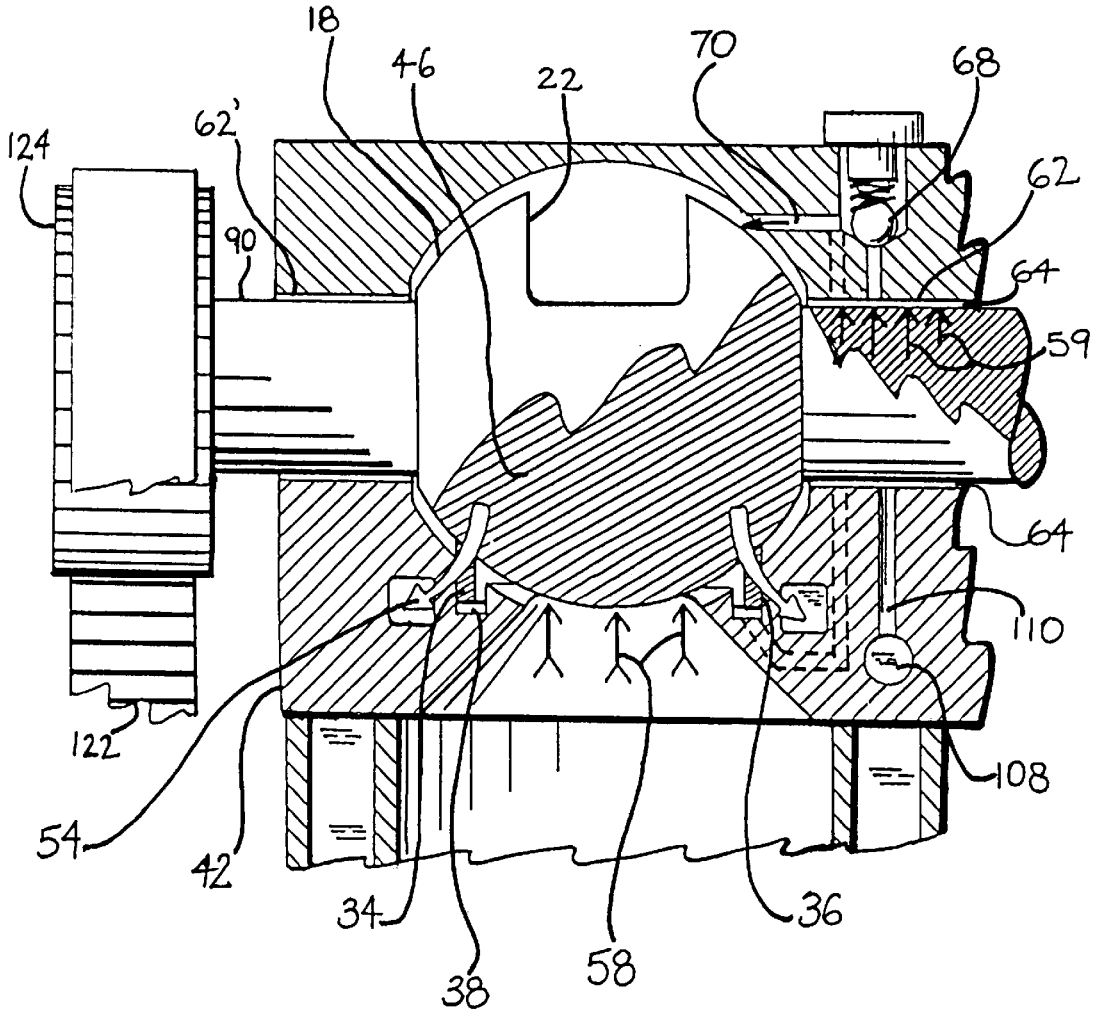
FIG. 2 is a sectional view perpendicular to the axis of a spheroidal valve illustrating oil metering mechanism and drive means for the valve from engine crankshaft.

As illustrated in FIG. 1, a spheroidal rotary valve 10 described herein is suitable for controlling, with a single valve unit, both the intake flow 12 and exhaust flow 14 of an internal combustion engine cylinder 16 operating at BMEP's above 100 psi. A spheroidal valve rotor 18 is shown mounted on valve shaft 90 for rotational operation within cavity 19 defined by cylinder head 80. In typical use, valve 10 is operated by drive means from the engine's crankshaft. One well known drive means is shown in FIG. 2 comprising a toothed timing belt 122 driving a sprocket 124 attached to valve shaft 90 wherein a four stroke cycle engine is operated with valve rotor 18 turning at one-half crankshaft speed.

Also shown in FIG. 1 is a novel construction for cylinder head 80 containing rotary valve 18. Head 80 is made in two parts comprising a cap 84 which bolts to casing 42 which in turn bolts to cylinder block 86. Parting plane 88 between the cap and casing is on a diagonal so as to allow exhaust port 78 to lie entirely within the casing and inlet port 94 to lie entirely within the cap. Since almost no heat enters the cap from the inlet port or from other sources, the cap needs no cooling. The casing, on the other hand contains the exhaust port, a major source of heat, as well as casing insert 40, another source of heat. Thus, the casing is fitted for cooling such as the liquid cooling illustrated. Another advantage of the diagonal split is that inlet and exhaust ports can each be entirely within either the casing or in the cap, and their integrity is not affected by the presence of the necessary parting plane for assembly of the valve shaft and rotors which typically run along parallel with a bank of an engine block.

An exhaust heat extractor 96 is illustrated in exhaust port 78 which extractor has an insulating liner to allow exhaust heat to continue downstream without too much transfer to the walls of the extractor. Heat which does reach these walls conducts out to air fins 98 where it is dissipated into the atmosphere, thereby allowing valve rotor 18 to run cooler.

Insulation 100 is also placed on the inside spherical surface of casing 42 in a region adjacent the exhaust port 78. This insulation reduces the heat absorbed from spilled exhaust flow during the exhaust blowdown and exhaust stroke of the engine.

Also shown in FIG. 1 is that coolant flow 100' is directed directly against structure supporting sealing ring 34 where it is passed over by exiting exhaust gas. This portion of ring 34 receives the most exhaust heat and therefore should receive the most intense cooling.

Although illustrated with both an inlet and an exhaust port, valve 10 is also suitable for individual control of either the exhaust flow or the inlet flow of an engine. The gist of the invention is a combination of elements which together make a rotary valve practical.

Figure 5:
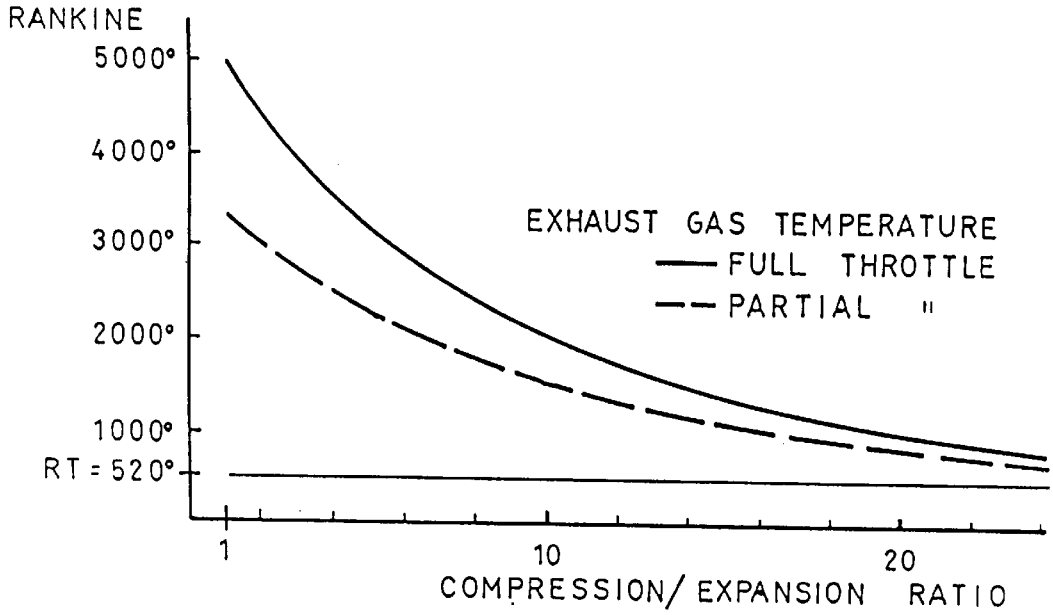
FIG. 5 is a graph of exhaust gas temperature versus compression/expansion ratio of an engine.

One group of elements reduces heat input into the valve rotor 18. A higher compression ratio than standard is used in the engine combustion chamber 20 to reduce the exhaust temperature, a higher ratio than can be used in a conventional engine chamber wherein the exhaust valve is a hot spot which can precipitate pre-ignition or detonation. The rotary valve runs cool at about the same temperature as the engine cylinder wall, leaving the spark plug tip as the only hot spot remaining in the chamber. The reduction in exhaust gas temperature that is obtainable is given in the graph of FIG. 5.

Second, a peripheral port 22 is used in the spheroidal valve rotor. The alternative would be a "through port" which enters and exits the rotor surface. A through port however presents about three times as much surface area to the gas flows and would absorb excessive heat from the exhaust.

Figure 4:
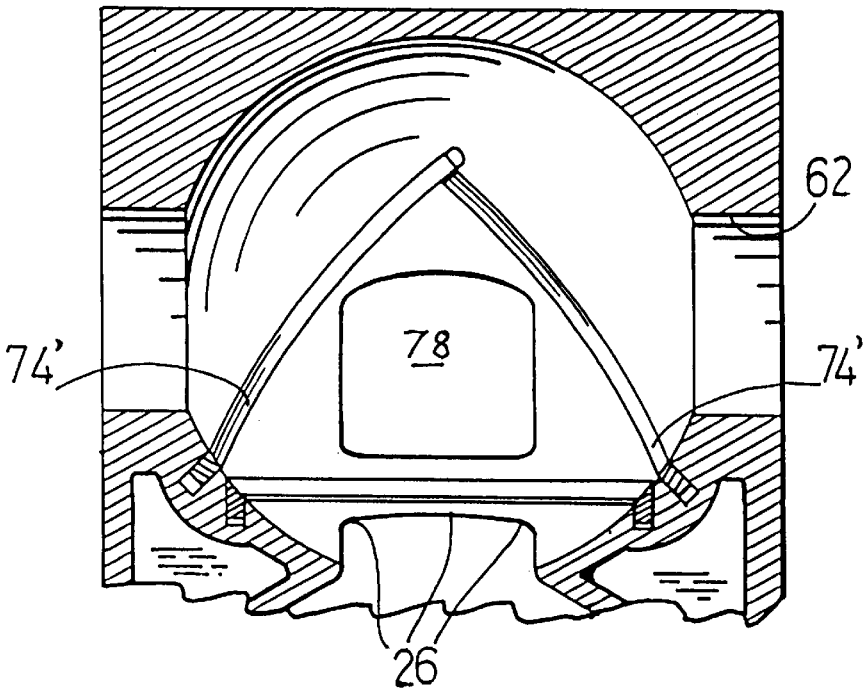
FIG. 4 is a view partly in section, of a spheroidal valve casing with rotor removed, showing a gas seal, oil wiper strips arranged to divert oil away from the ports, and the exhaust port.

With reference to FIGS. 1 and 4, the opening end 24 of the rotor port and the opening end 26 of the chamber port are both shaped (squared off) to complement each other in producing quick opening and rapid release of exhaust gas. Rapid release reduces heat transfer to the valve rotor. Quick closure of the exhaust port is also desirable to switch to the inlet phase of the gas cycle.

Figure 21:
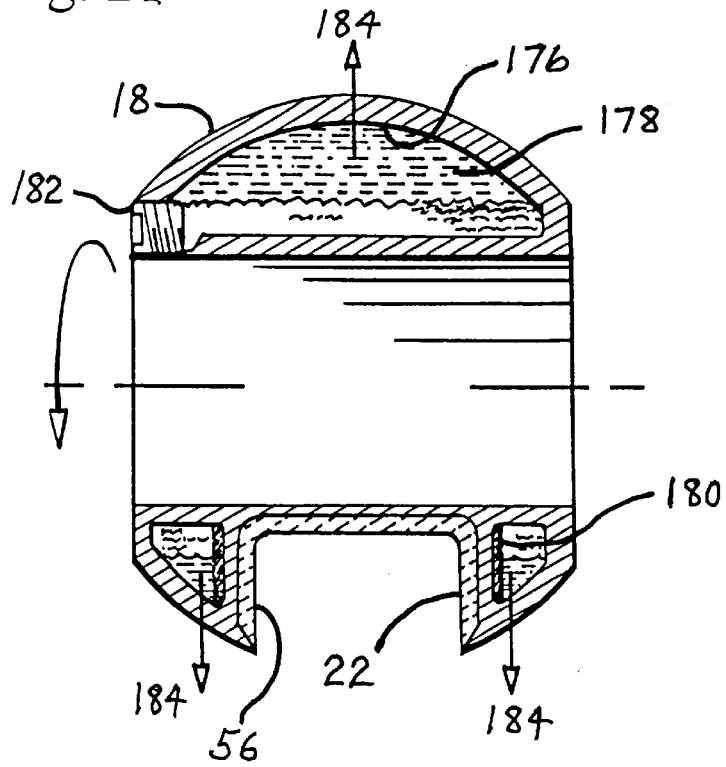
FIG. 21 is a sectional view of a hollow spheroidal rotor containing an internal coolant.

As shown in FIGS. 1 and 21, the rotor port 22 contains a liner 56 to effect thermal insulation and reduce heat flow into the bore 30 of the rotor port 22 and on into the rotor 18. Liner 56 may be a sheet of refractory material fixed in place in port 22. An interface created between liner 56 and bore 30 in the body of the rotor serves as effective thermal insulation, although additional insulation such as a sheet of thin refractory metal e.g. stainless steel foil may be advantageous.

Another element needed in the valve is cooling and with reference now to FIGS. 1 and 2, a cooling mechanism is built into valve 10. Provision is made for heat absorbed in the vicinity of port 22 to travel across rotor 18 and transfer as per arrows 54 to rotor sealing ring 34. From the sealing ring, heat transfers to the outer wall 36 of groove 38 which contains sealing ring 34, groove 38 being defined either a casing insert 40 as illustrated in FIG. 1, or by casing 42 itself itself as illustrated in FIG. 2. From this outer wall 36 of groove 38, heat is conducted to a means for cooling such as coolant duct 44 in FIG. 1. Most of the heat entering casing 42 enters in a rotor sealing ring 34 towards exhaust port 78, this band having a width equal to that of rotor port 22. To prevent overheat (a temperature in excess of 400 degrees F at which temperature conventional engine oils begin to decompose rapidly) in this band and portion of rotor sealing ring 34, fresh coolant 82 is directed into annular duct 44 immediately adjacent rotor sealing ring 34 and exhaust port 78 before the coolant has received heat from other parts of the engine.

To carry additional heat away from rotor 18 and base of casing 42, a heat extractor 96 made of high thermal conductivity metal (such as a relatively pure copper alloy) conducts heat from the rotor end out away from the engine where it is dispersed to the air by air fins 98. An internal lining of thermal insulation 76 reduces the heat transferred to extractor 96 and allows more heat to pass out with the exhaust. An additional exhaust heat load is placed on casing 42 at cavity wall 100 and 100' just above and below the exhaust port. This heat load is avoided by thermal insulation 102 applied to the cavity wall in an area around exhaust port 78. A suitable construction and a preferred embodiment for cylinder head 80 containing rotary valve 10 is to divide said cylinder head into a base 42 which bolts to engine block 86 and a cap 84 which bolts to the base 42 at parting plane 88 which plane 88 also includes the axis of valve shaft 90. By making the parting plane at a sharp angle with the base cylinder head joint 92, it is possible to confine coolant 82 and exhaust port 78 and most of the valve heat within base 42. Similarly, the inlet port(s) 94 may be confined to cap 84.

When gas pressure is high in combustion chamber 20, rotor sealing ring 34 is forced into high pressure contact with rotor 18 and with casing 42 (or insert 44 depending upon which construction is being referred to). Rapid thermal transfer therefore occurs from the rotor to the casing during these periods of high gas pressure which pressure pulses are created each time combustion takes place in the gas cycle.

Internal heat transfer in the valve rotor carries the rotor port heat across to the area of the rotor surface which bears the high gas pressure indicated by arrows 58 illustrated in FIG. 2 during and immediately following combustion in the engine. Internal heat transfer is enhanced if the core 46 of rotor 18 is made of a material having high thermal conductivity such as aluminum. Aluminum can be used as the surface material for rotor 18 and bearing surface for seal 34 in which case an Al casting alloy such as Type A390.0 (having 17% Si and 4.5% Cu) or 393.0 is preferred.

Figure 3:
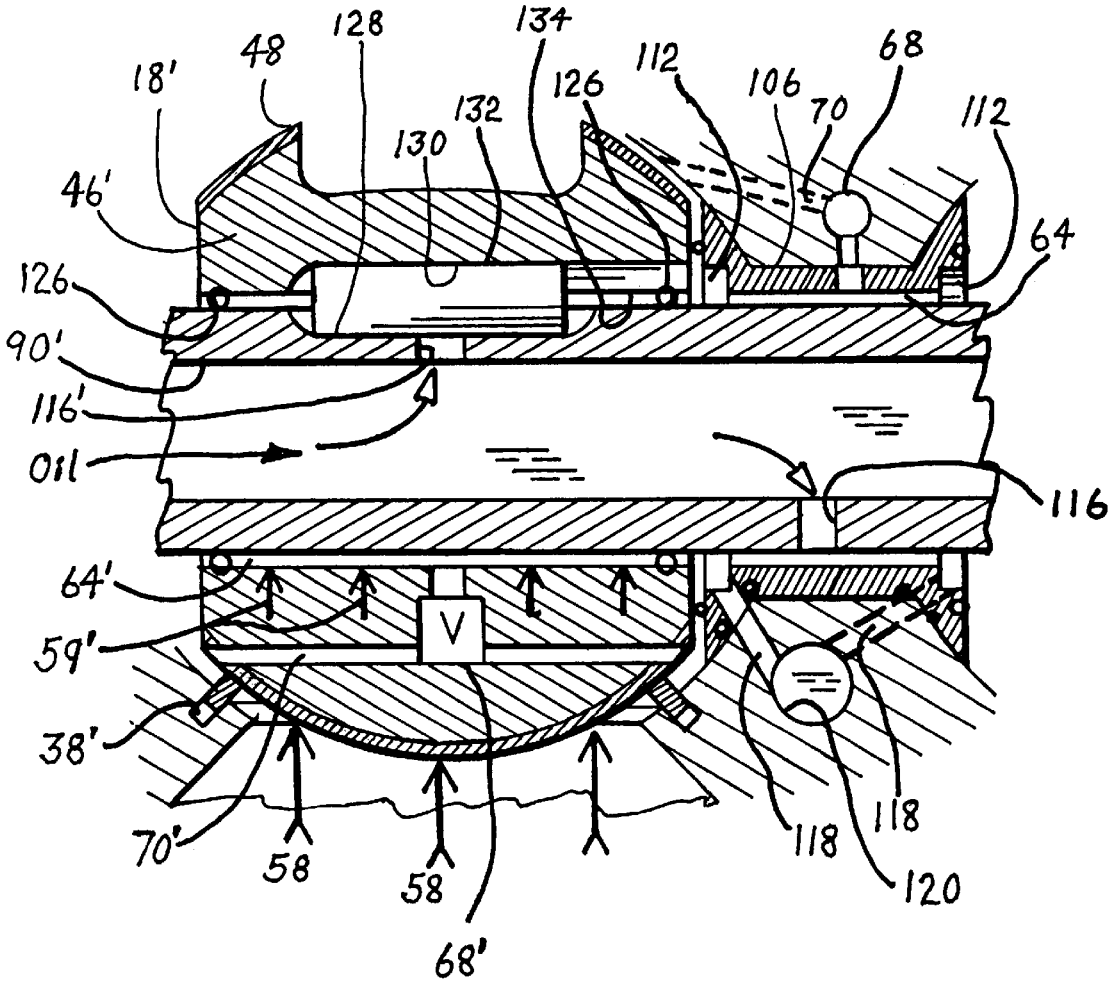
FIG. 3 is a sectional view of a spheroidal rotor showing rotor drive, torsional damping means, oil metering means, and insert bearing.

An alternative and preferred embodiment is illustrated in FIG. 3 wherein rotor 18' is bimetallic with a core 46 of a high thermal conductivity material such as aluminum covered with a good wearing surface metal 48 such as a high Brinell hardness cast iron.

Another alternative for conducting heat across the rotor is illustrated in FIG. 21 wherein rotor 18" is hollow and contains a heat transferring liquid 50 which may be sealed into the rotor by plug means 52. Liquid 50 may be a vaporizable liquid such as an alcohol which can transfer heat by vaporization at the area of heat input and condensation at the area of heat removal, or a liquid such as an oil or a liquid metal (e.g. Hg or Na) which can flow or splash around and carry heat with it. In this embodiment, the preferred rotor material is a high strength cast iron which can be accurately cast in thin sections.

Referring now to FIGS. 1 and 2, lubrication is required for the rotor sealing ring 34, which is the only required contact between rotor 18 and casing 42. Referring to FIG. 2, rotor 18 is supported by valve shaft 90 which runs on journal bearings at 62 and 62'. These bearings may be machined directly in casing 42 as in FIG. 2, or composed of insert bearing shells 106 as in FIG. 3. Oil is supplied to the bearings by an oil duct 108 and feed duct 110, or via a hollow valve shaft 90' and radial feed holes 116 which pass oil through the shaft to the bearing shells. Oil is returned from oil seals 112 at each end of each bearing shells 106 via pickup ducts 118 to a common duct 120 from which oil is returned to the engine.

An oil metering method and system 60 operates from high pressure pulses developed in an oil film 64 which supports rotor 18 in journal bearings 62 and 62' within casing 42. These pressure pulses result from gas pressure pulses illustrated by arrows 58 in FIGS. 2 and 3, which cause mechanical pressure pulses 59 from valve shaft 90 against oil film 64. Each pressure pulse in film 64 pumps a minute amount of oil up duct 66' past pressure relief valve 68 into lubricant distribution ducts 70 and 72. Relief valve 68 may typically be a ball held on a seat by a spring.

From duct 70, oil is spread onto the rotor in a thin film by wipers such as 74 in FIG. 1 and 74' shown in FIG. 4. Wiper 74 is a circular split ring. Wipers 74' are spring loaded segments of a ring arranged to divert oil away from the ports.

Another embodiment of the oil metering system is illustrated in FIG. 3 wherein oil flow 91 from 20 the core of valve shaft 90' flows radially out through port 116' and fills oil film 64' between rotor 18' and valve shaft 90'. Oil film 64' is sealed in between the rotor and the shaft by oil seals 126 at each end of the rotor. Arrows illustrating gas pressure 58 on rotor 18' create pressure 59' on oil film 64' ejecting oil from the film out duct 66' to pressure relief valve-V 68' and thence thru distribution ducts 70' within rotor 18' to the surface of the rotor.

Figure 7:
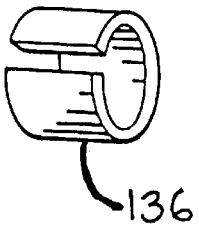
FIG. 7 is a perspective view of a split ring metering valve.
Figure 6:
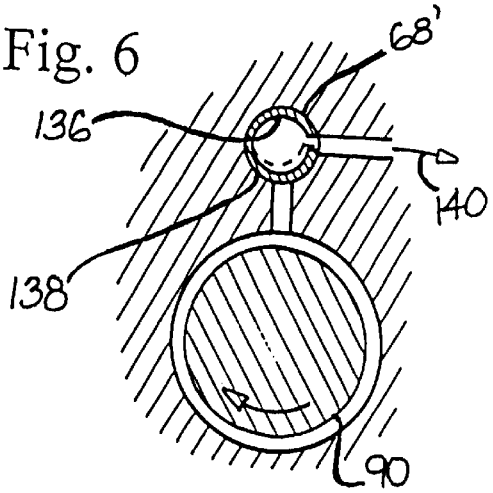
FIG. 6 is a partial view in section of a metering mechanism with split ring valve.

Another embodiment of the oil metering mechanism is illustrated in FIGS. 6 and 7 wherein valve shaft 90 pumps oil up duct 66' to pressure relief valve 68' which comprises a split tubular spring 136 located in a cylindric valve seat 138. Oil pressure collapses spring 136 slightly allowing oil to meter past it and feed out of the valve 68' as per arrow 140.

To facilitate assembly of the rotary valve, valve shaft 90' in FIG. 3 defines a groove 128 which aligns with a groove 130 defined by the internal diameter 134 of valve rotor 18'. A pin 132 is fitted into these grooves 128 and 130 to provide rotary drive for the rotor. In addition, an oil film created between pin 132 and the two grooves provides torsional damping for the valve shaft. In the case of a multi-cylinder valve assembly having up to eight possible valves on a single shaft, such damping is desirable.

Figure 8:
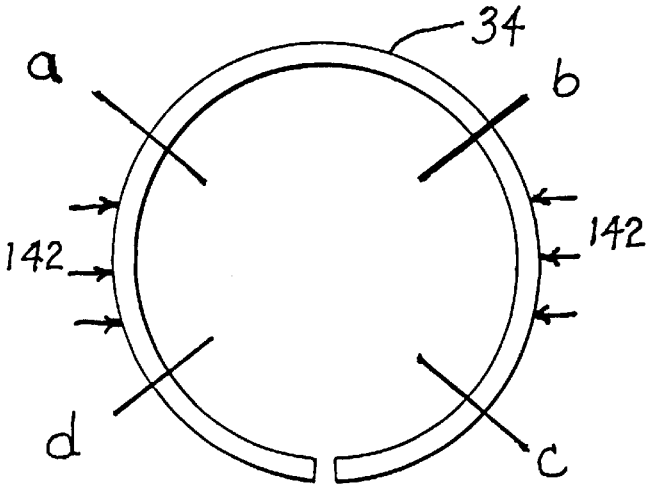
FIG. 8 is a planform view of the circular sealing ring of FIG. 10 taken on line 8—8, the ring being formed into an oval by an oval containment groove.

To reduce friction and wear between rotor sealing ring 34 and rotor 18 as shown in FIG. 1, several geometric modifications are available. In FIG. 8, a planform view of a rotor sealing ring 34 is shown with an oval form due to being fitted into an oval groove, not shown. The groove compresses seal 34 by a few thousandths of an inch (for a rotor with a diameter of about 3") as per arrows 142 to create the oval shape. This ovality causes the seal to bear more heavily on the rotor along its sides between a and d and between b and c, and less heavily on the rotor periphery which bears between a and b and between c and d.

Another method of reducing friction and wear on the seal is to chamfer the rotor. In FIGS. 9 and 10, a peripheral chamfer 144 of roughly a thousandth of an inch is blended into the rotor spherical periphery surface at the closing end of port 22. Chamfer 144 will reduce a tendency of the resilient sealing ring 34 to hook on the closing end of the rotor port as it approaches. A resilent sealing ring will also tend to droop into port 22 when the port is open. This causes the seal to wear at the edges of port 22. To counteract this, side chamfers 146 are blended into the rotor surface, again on the order of a thousandth of an inch for a 3" diameter rotor.

A third embodiment for reducing wear and friction is to assymmetrically shape the sealing ring 34' as illustrated in FIGS. 11 and 12. The sides of the ring 148 are slightly wider than the peripheral surfaces 150 to achieve a disparity in pressure between the sides which bear on the rotor adjacent its bearings, and the peripheral surfaces 150 which bear on the rotor peripheral surface and are crossed by the rotor port. Due to asymmetry in sealing ring 34', it is preferably pinned to ensure that it is initially aligned and remains with the rotor's plane of rotation.

Another embodiment to reduce wear and friction on the sealing ring is illustrated in FIGS. 13 and 14. In this element, a spring 152 which is placed under sealing ring 34 in groove 38 or 38' such as in FIGS. 1, 2, and 3 is designed to have non-uniform tension around its periphery. With a wire spring or a thin metal spring, this tension variation may be achieved by varying the spacing between kinks 155 formed in the circumference, as illustrated. To achieve the desired disparity in force on sealing 34 between sides and periphery p, the kinks 153 are placed more closely along the sides of spring 152.

Another embodiment to provide a disparity between sealing ring pressure between the ring sides and periphery is illustrated in FIGS. 15 and 16. In this embodiment, rotor 18', rotating as per arrow R, is spheroidal and elongated in the direction of its rotational axis whereby it bears on sealing ring 34 more heavily along its sides 156 (adjacent the bearings) than it does over its peripheral band or region 158 denoted by dashed lines. This elongation need only be slight on the order of a few mils difference between axial and peripheral diameter for a 3" rotor, dependent upon the degree of disparity desired in pressures on the sealing ring. When no gas pressure is forcing the ring against rotor 18', it will ride with a slight clearance 178 at the periphery of the rotor. Under gas pressure from the engine combustion chamber, resiliency of sealing ring 34 allows it to deflect into dashed position 180 and fit tightly against rotor 18'.

Figure 17:
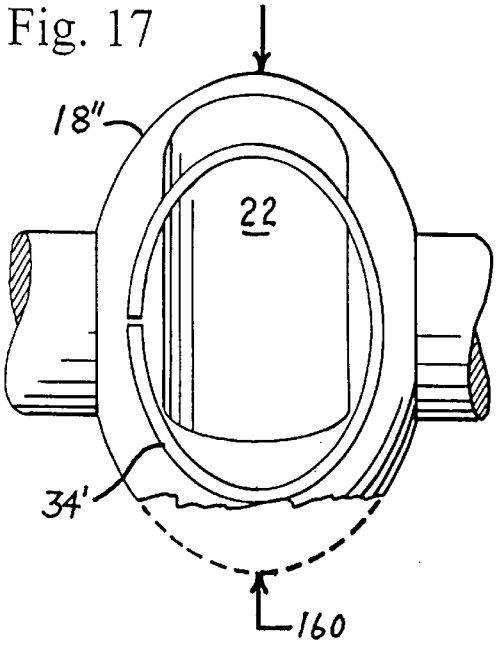
FIG. 17 is a perspective view of an ellipsoidal valve rotor.
Figure 18:
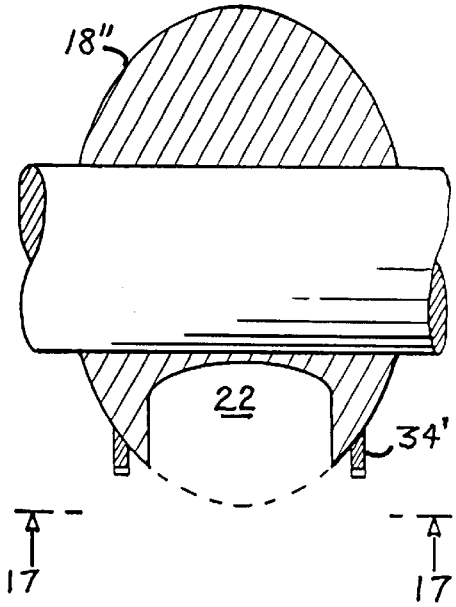
FIG. 18 is a sectional view along line 17—17 of FIG. 17.

Referring now to FIGS. 17 and 18 rotor 18" is formed as an ovoid or ellipsoid whereby the peripheral diameter 160 is greater than the axial diameter, not shown. The sealing ring 34' to fit and seal against this rotor will typically approximate an ellipse, although other shapes can of course be devised. With an ellipsoid ratio on the order of 1.5:1 or greater, the size and associated breathing capacity of port 22 can be increased by 50% or more, with no major disadvantages.

Figure 19:
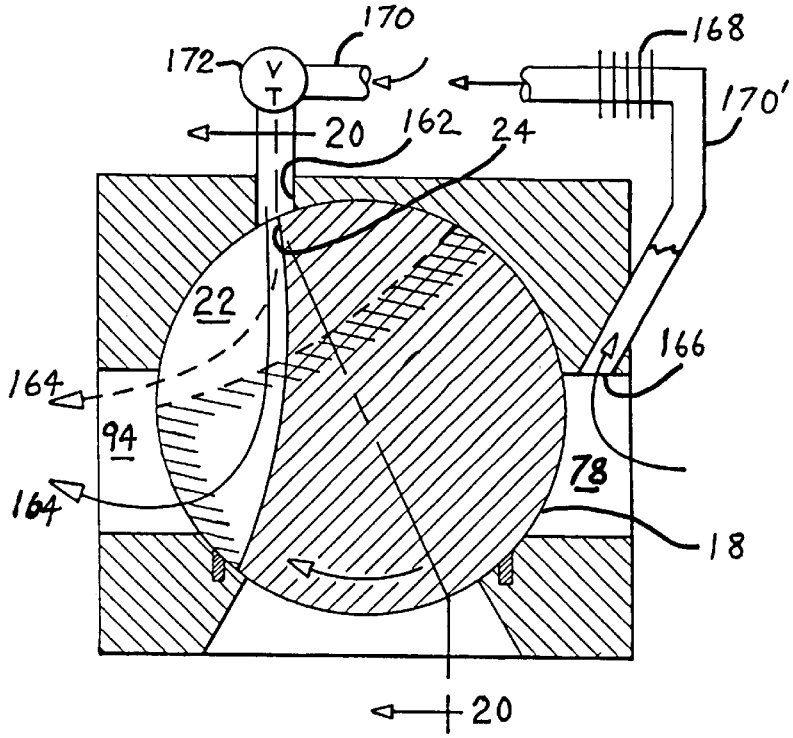
FIG. 19 is a sectional view of a rotary valve with means for scavenging the rotor port and alternative sources for the scavenge gas.
Figure 20:
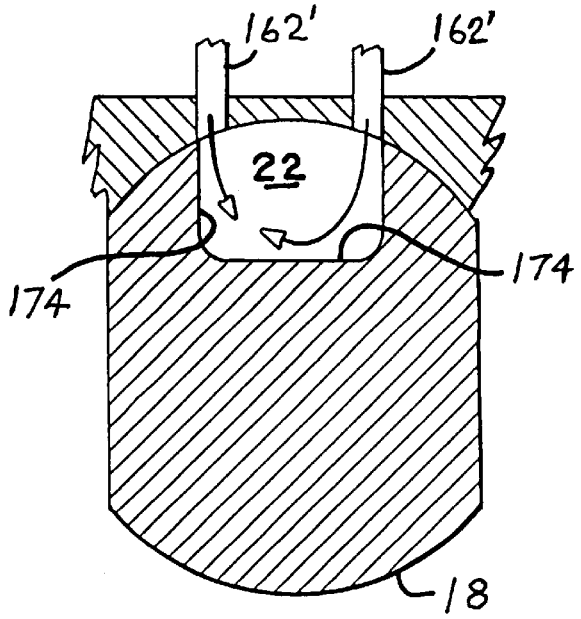
FIG. 20 is a partial cross sectional view along line 20—20 of FIG. 19 illustrating specific scavenging within the rotor port.

Port 22 of rotary valve 10 has an inherent characteristic of carrying a trapped volume of inlet gases around to the exhaust port and losing these gases to the exhaust flow. In a Diesel, this would not present a problem since no fuel is in the inlet flow. In an Otto cycle engine, fuel is presently present in the inlet flow and in this case will be lost. To prevent or greatly reduce such loss, a scavenging mechanism has been devised as illustrated in FIGS. 19 and 20. In normal engine operation, after rotor 18 has passed the inlet phase and port 22 is in the position of FIG. 19, inlet gases are trapped in port 22. At the rotation position shown, duct 162 passing through casing 42 is uncovered by the opening edge 24 of port 22. Scavenge gas now enters from duct 162 fed from scavenge gas feed line 170 and fills port 22 forcing the trapped inlet gases as per arrows 164 back into the inlet manifold, not shown. A control valve 172 may be used to adjust gas flow to the scavenge duct 162 in correlation with engine throttle opening and RPM. Scavenge gas or air may also be used, with suitable control, for leaning the inlet gas mixture.

Various scavenge gases may be used, the most convenient being ambient air. Ambient air will however not scavenge well once the inlet manifold pressure nears atmospheric which it will do near full throttle operation. Modern automotive engine often have an air compressor used to feed a catalytic convertor. Air could be obtained from the same air pump. Alternatively, exhaust gas can be used as the scavenge gas and is available at slightly over atmospheric pressure if captured in the exhaust port 78 where it is struck by the initial blowdown gas when the exhaust first opens, as located at entrance duct 166. For maximum power output from the engine, the exhaust gas used for scavenge should be cooled as by intercooler 168 located in alternative gas feed line 170'.

To promote scavenging efficiency and maintain cleanliness of the port walls, duct 162' as shown in FIG. 20 may be divided or so shaped to produce a gas jet into port 22 which scrubs and scours the walls 174 of port 22.

FABRICATION AND TESTS

Fabrication of a spherical valve was simplified in that the sphere and its socket are each definable by a single dimension, the diameter. A 1972 Ford Pinto engine was used as a test bed, and the front cylinder used for experiments while the other cylinders were disabled. Prototype cylinder head were mounted on the block, which provided a 3.55" bore cylinder with a 3.0" stroke and a displacement of about 30 cubic inches. The crankshaft driven timing belt provided synchronized drive for the rotary valve shaft.

For the first prototype, a 2.75" diameter carbon steel rotor was used and a cast iron sealing ing of 2.0" diameter with a thickness of 0.050". A spring under the ring was found to be useful but certainly not essential, as runs of an hour were made without it. A casing was fabricated from aluminum which served also to define the groove for containment of the sealing ring.

A satisfactory gas seal was obtained in the first spherical valve prototype and gave good performance for test periods up to about five minutes after which it overheated. Water cooling was then applied to the gas seal, producing workable cooling. The addition of an insulating liner to the rotor port provided the next major gain in control of rotor temperature. Subsequent tests were then run for multiple periods of an hour each with excellent control of temperature.

Metering was developed and ultimately reduced to a measured oil usage of less than one quart per 1,100 mile equivalent in a Pinto, extrapolating from the single cylinder test engine operating at between 1,500 and 2,000 crankshaft RPM. Oil seals for the valve shaft bearing were developed until their oil leakage into the valve casing was undetectable. Wear on the sealing ring was ultimately reduced to a negligible level.

What is claimed is:

1. In a spheroidally surfaced rotary valve for controlling gas flows to and from a cylinder of an internal combustion engine, a valve casing attached to said cylinder, a valve rotor supported on an oil film against a shaft within said casing, a port defined by said casing and providing gas flow connection between the cylinder and the rotor surface such that cyclic gas pressure from the cylinder acting on the rotor surface produces cyclic force against the rotor which are counteracted by said oil film, a means for metering oil lubrication to said rotor in correlation with said cyclic gas pressures comprising:

means providing for an oil feed to maintain said oil film, means providing for release of oil from said oil film during periods of high pressure created by said cyclic forces acting on said rotor, and means providing for transfer of said released oil to the surface of said rotor.

2. A means for metering oil as in claim 1 wherein said means providing for release of oil comprises a check valve.

3. A means for metering oil as in claim 1 wherein said means providing for release of oil comprises a porous plug.

4. A means for metering oil as in claim 1 wherein said means providing for release of oil comprises a capillary.

5. A means for metering oil as in claim 1 wherein said oil film on said shaft is located in a non-rotating junction between said rotor and said shaft.

6. A means for metering oil as in claim 1 wherein said oil film on said shaft is located in a rotating junction between said shaft and a bearing in said casing.

7. A means for metering oil as in claim 1 wherein said oil film is located in a journal bearing supporting said shaft which carries the rotor.

8. In an internal combustion engine of the type having at least a single cylinder with a piston reciprocating therein, a crankshaft coupled with said piston to receive power output and synchronize the operation of a rotary valve for selectively passing fluid gases to and from said cylinder, a valve stator enclosing a working end of said cylinder, said valve stator defining:

a cavity, a chamber port providing gas flow communication between said cavity and said cylinder, and at least one other port providing external gas flow communication with said cavity, a rotor mounted for rotation about a transverse axis within said cavity in timed relationship with said crankshaft, said rotor having a central band with a spheroidal outer surface having a running clearance fit with said cavity, and a peripheral port, said peripheral port having walls defined by said band to provide for passage of said fluid gases between said stator ports when said peripheral port and said stator ports are in alignment, a cooling mechanism to prevent overheating of said rotor comprising the combination of:

means providing for the transfer of heat from said walls of said peripheral port across said rotor to an area on said band substantially diametrically opposite to said peripheral port, said heat transfer means being at least equivalent to said rotor being fabricated from a material having a thermal conductivity at least equal to 12% of that of copper;

means providing for high thermal conduction in at least a region of said cavity circumscribing the juncture of said chamber port with said cavity, the thermal conductivity in said region being at least 25% of that of copper;

means providing for intensive cooling of said region of said stator cavity;

means for providing a lubricating oil film on said rotor;

a groove defined by said stator and located within said region, said groove encircling said chamber port and having an outer circumferential wall; and a resilient, thermally conductive ring seal having a thermal conductivity at least as high as 12% of that of copper fitted into said groove in such a way that when acted upon internally by gas pressure from combustion within said cylinder in excess of ambient gas pressure external to said ring, said ring seal will be gas actuated to contact said band of said valve rotor and at the same time contact said outer wall of said groove, whereby a superior pathway for the thermal transfer of heat is provided from said valve rotor through said ring seal to said cooling means in the stator while said resilient ring seal also serves at the same time to provide an efficient gas seal between said rotor and said chamber port.

9. The cooling mechanism of claim 8, further including means providing thermal insulation on said walls of said circumferential peripheral port whereby heat transfer is minimized between said fluid gases passing through said peripheral port and said rotor.

10. The cooling mechanism of claim 8, wherein said resilient, thermally conductive, ring seal comprises a split ring composed of cast iron.

11. The cooling mechanism of claim 8, wherein said means for heat transfer from said region of said stator circumscribing the juncture between said chamber port and said cavity further includes a cooling duct defined by said region and situated closely adjacent said groove, and means for providing a flow of coolant through said duct to vigorously remove heat from said region.

12. The cooling mechanism of claim 8, wherein at least said region of said stator is fabricated from a material having a thermal conductivity greater than 25% of that of copper selected from the group consisting of aluminum alloys, magnesium alloys, and copper alloys.

13. The cooling mechanism of claim 8, wherein the exterior surface of said central band is composed of cast iron.

14. The cooling mechanism of claim 13, further including a cavity defined by said rotor and said cavity contains a heat transferring liquid whereby motion of said liquid acts to carry and distribute heat around said central band of said rotor.

15. The cooling mechanism of claim 8, further including a rotor cavity defined by said rotor and a vaporizable liquid contained within said rotor cavity whereby heat emanating from said peripheral port of said rotor vaporizes said vaporizable liquid and the resultant vapors migrate to cooler portions of said rotor cavity where they condense and deposit said heat.

16. The cooling mechanism of claim 8, wherein the core of said rotor is composed of a metal having a thermal conductivity at least equal to 40% of that of copper and said band is composed of a thin layer of cast iron.

17. The cooling mechanism of claim 8, further including said thermally conductive region circumscribing said chamber port being formed as an insert and said insert contains said groove and said resilient, thermally conductive ring seal and said chamber port and said insert is fitted into said stator whereby said insert provides gas flow connection between said cylinder and said rotor.

18. The cooling mechanism of claim 8, wherein said other port defined by said stator is an inlet port for said engine and said stator further includes and defines an exhaust port for the release of gases from said engine.

19. In an internal combustion engine of the type having at least a single cylinder with a piston reciprocating therein, said piston being coupled to a crankshaft for power output and for synchronizing the operation of a rotary valve for selectively passing intake and exhaust gases to and from said cylinder, a valve stator attached to and enclosing a working end of said cylinder, said valve stator defining a chamber port in gas flow connection with said cylinder, a cavity in gas flow connection with said chamber port, and an intake port and an exhaust port providing external gas flow connections with said cavity, a rotor of said rotary valve mounted for rotation about a transverse axis with running clearance within said cavity of said stator in timed relationship with said crankshaft, said rotor having a central band with a spheroidal outer surface which provides a close running fit with said cavity and said chamber port, and a circumferential peripheral port with walls defined by said band, said band and peripheral port providing for passage of inlet gases into said cylinder when said intake port, peripheral port, and chamber port are aligned, for sealing off said chamber port when said peripheral port is out of alignment with said chamber port, and providing for release of exhaust gas from said cylinder when said peripheral port, exhaust port, and chamber port are aligned, a temperature control mechanism in said rotor to prevent overheating comprising the combination of:

a metal liner fitted into said peripheral port to minimize heat transfer from said gas flows through said peripheral port into said rotor;

said central band of said rotor being fabricated of a material having thermal conductivity at least as high 12% of that of copper, said material being selected from the group consisting of cast iron, alloys of aluminum, and cast steel;

a heat transfer means to provide for substantial transfer of heat from the area adjacent said peripheral port to a general area of said band diametrically opposed to said peripheral port, said general area of said band being subjected to high gas pressure from said cylinder during operation of said engine;

said stator; at least in a region circumscribing said chamber port where it adjoins said cavity, being fabricated of a material having a thermal conductivity greater than 25% of that of copper selected from the group consisting of aluminum alloys, magnesium alloys, and copper alloys;

an encircling groove defined by said region of the stator cavity and encircling said chamber port;

a split ring seal fitted into said encircling groove, said seal being fabricated from a material having a thermal conductivity greater than 12% of that of copper;

a coolant duct defined by said stator and encircling the juncture between said chamber port and said cavity placed closely adjacent to the outer wall of said circular groove;

a flow of coolant through said coolant duct to withdraw heat specifically from said outer wall of said circular groove and more generally from said region of said cavity; and an oil feed mechanism to maintain a thin film of lubricating oil on the surface of said band, whereby when said split ring seal is acted upon internally by gas pressure from combustion within said cylinder in excess of ambient gas pressure external to said seal, said seal is forcibly gas actuated to eject slightly from said groove and contact said general area of said band of said rotor and at the same time, expand slightly in a radial direction such that the seal forcibly contacts the outer wall of said groove of said cavity whereby a superior pathway for thermal transfer of heat is provided from said band of said valve rotor to said split ring seal, and thence to said region of said stator and then into said coolant duct and coolant during operation of said internal combustion engine.

20. The mechanism of claim 19 wherein said heat transfer means comprises said valve rotor having a substantially solid core of high thermal conductivity metal selected from the group consisting of cast aluminum, alloy aluminum, cast iron, cast nickel-iron, ductile cast iron, malleable cast iron, and carbon steel.

21. The mechanism of claim 19 further including a cavity defined by said valve rotor and a heat transferring fluid contained in said cavity whereby said heat transferring fluid provides said heat transferring means.

22. The mechanism of claim 19 wherein said band is fabricated from a metal having a thermal conductivity of at least 12% of that of copper and is selected from the group consisting of cast iron, cast steel, steel, and cast nickel-steel.

23. The mechanism of claim 19 wherein said oil feed mechanism comprises a pressure relief valve which receives oil from an oil film within a journal bearing which supports at least a portion of the force exerted on said rotor by cyclic gas pressures that occur in said cylinder during operation of said engine.

24. The mechanism of claim 19 wherein said oil feed mechanism comprises a pressure relief valve which receives oil from an oil film between said valve rotor and a valve shaft on which said valve rotor is slidably mounted for rotation within said stator.

25. The mechanism of claim 20 further including said stator being split into a base and a cap which separable parts permit installation and removal of said rotor, said base being attached to said cylinder and said cap being attached to said base, said split between said base and cap being parallel with the rotational axis of said rotor and passing substantially through said axis while at the same time being on an angle of between 50 and 80 degrees with the axis of said cylinder.

26. The mechanism of claim 20 wherein said exhaust port is defined by said base and said intake port is defined by said cap.

27. The mechanism of claim 25 further including an insert which defines said chamber port and said region of the cavity and said groove, said insert providing facility for precision.

* * * * *